United States Patent [19]

Ureda

[11] 4,325,456

[45] Apr. 20, 1982

[54] ACOUSTICAL TRANSFORMER FOR COMPRESSION-TYPE LOUDSPEAKER WITH AN ANNULAR DIAPHRAGM

[75] Inventor: Mark S. Ureda, Woodland Hills, Calif.

[73] Assignee: Altec Corporation, Anaheim, Calif.

[21] Appl. No.: 196,074

[22] Filed: Oct. 10, 1980

[51] Int. Cl.[3] ..... G10K 11/02

[52] U.S. Cl. ..... 181/159; 181/185

[58] Field of Search ..... 181/152, 159, 185–186; 179/115.5 H

[56] References Cited

U.S. PATENT DOCUMENTS 1,845,768 2/1932 Stokes ..... 181/159

4,050,541 9/1977 Henricksen ..... 181/159

FOREIGN PATENT DOCUMENTS 939879 2/1956 Fed. Rep. of Germany...179/115.5 H

*Primary Examiner*—L. T. Hix

*Assistant Examiner*—Thomas H. Tarcza

*Attorney, Agent, or Firm*—Edward A. Sokolski

[57] ABSTRACT

An acoustical transformer or "phasing plug" for coupling the sound from an annular diaphragm to the throat of a compression-type loudspeaker. The phasing plug in the invention has the general shape of a doubly-truncated cone with an annular surface located on the larger end of the truncated cone and positioned adjacent to the diaphragm. The conical surface of the cone has spaced radial slots or channels formed therein connecting the truncated surfaces of the cone. These channels form air passageways for propagation of sound waves. The walls of the slots or channels are tapered such that the cross-sectional areas of the channels increase from their inlet ends near the speaker diaphragm, towards the outlet ends, positioned at the throat of the horn. The phasing plug provides an improved impedance match between the output of the annular diaphragm and the input of the horn.

6 Claims, 6 Drawing Figures

ACOUSTICAL TRANSFORMER FOR COMPRESSION-TYPE LOUDSPEAKER WITH AN ANNULAR DIAPHRAGM

BACKGROUND OF THE INVENTION

This invention relates to compression-type loudspeakers driven by an annular diaphragm, and more particularly to an improved acoustical transformer or phasing plug for use in such loudspeakers.

In compression-type loudspeakers, an acoustical transformer, commonly known as a "phasing plug", is used to improve the impedance match between the output of the speaker diaphragm and the throat of the horn. The improved impedance match allows more acoustic power to be transferred from the diaphragm, particularly at low frequencies. Furthermore, the phase plug reduces the apparent size of the annular diaphragm, thus improving high frequency response and dispersion. In most applications, the throat diameter at the horn is small compared to the diameter of the annular diaphragm.

In the prior art, acoustical transformers or phase plugs for use with compression-type loudspeakers driven by an annular or ring diaphragm have consisted of a plug having an annular slot located next to, and concentric with, the annular ring diaphragm. The phase plug contained an annular, axially symmetric passageway connecting the annular slot to the mouth of the horn. The annular passageway typically expanded in cross section from the diaphragm to the throat so as to nearly cover the entire throat of the horn. However, the phasing plug utilizing an annular slot adjacent to the diaphragm exhibits poor dispersion characteristics at higher frequencies because the apparent size of the source is large compared to the wavelength.

Other prior art, such as that described in U.S. Pat. No. 4,050,541, utilizes a series of radial slots adjacent to a domeshaped diaphragm, but that invention does not teach the use of channels with an annular diaphragm.

SUMMARY OF THE INVENTION

Rather than use an axially symmetric, annular slot adjacent to the annular diaphragm to obtain a desired compression ratio, the device of the present invention utilizes a series of channels oriented along the conical surface of the cone. The ends of the channels open adjacent to the annular diaphragm. The channels provide a series of passageways connecting openings adjacent to the annular diaphragm to the throat of the horn. The series of channel openings adjacent to the annular diaphragm provides an improved means of loading the annular diaphragm which reduces or avoids problems associated with diaphragm "breakup" at higher frequencies. The channels transform the sound waves generated by the annular diaphragm into a planar wave at the exit of the transformer.

The words "planar wave" are used herein to mean a sound wave in which the phase of the pressure wave is substantially uniform over a plane, but the pressure wave is not necessarily in phase with the volume velocity at this plane.

DESCRIPTION OF THE PREFERRED EMBODIMENT

Figure 1:
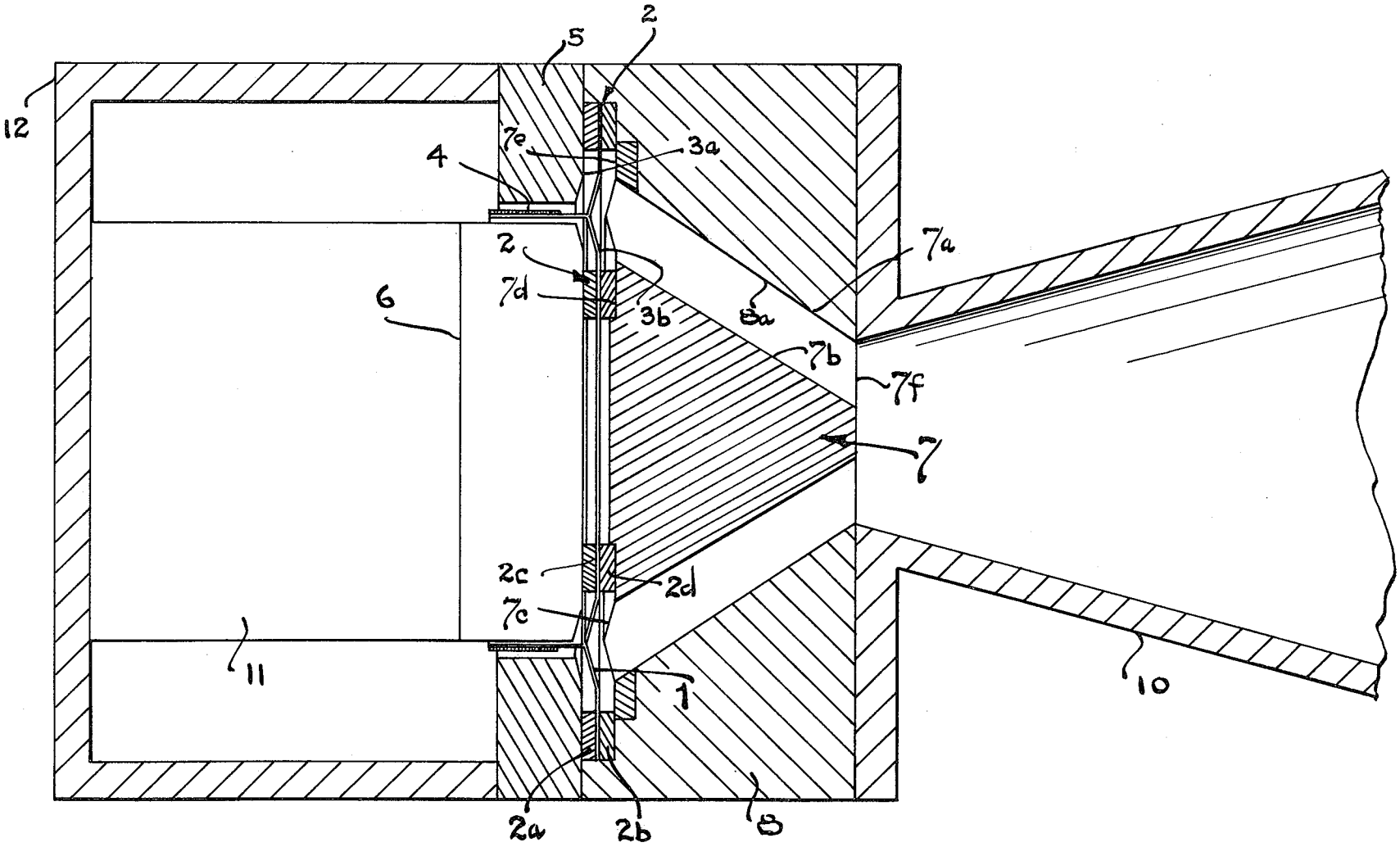
FIG. 1 illustrates the acoustical transformer in use in a compression-type loudspeaker driven by an annular diaphragm.

Referring now to FIG. 1, which illustrates the preferred embodiment of the invention installed in a compression-type loudspeaker 10. The annular speaker diaphragm 1 is resiliently mounted between support rings 2, comprised of parts 2*a*, 2*b*, 2*c*, and 2*d*, by means of flexible annular suspension members 3*a* and 3*b*. A voice coil 4 is wound on the coil support portion of the diaphragm structure and is located in the magnetic gap formed between pole piece elements 5 and 6. The acoustical transformer or phasing plug 7 is mounted with a portion of its conical, outer surface 7*a* in abutment against the mating surface 8*a* of frame 8. However, the outer surface 7*a* and the mating surface 8*a* need not be conical in shape, although they should be located substantially adjacent to each other. The central portion of the inner periphery of the phasing plug is formed by the conical surface of plug portion 7*b*. The outer surface 7*c* of the plug is in the form of an annular ring having a surface contour which substantially conforms to the shape of annular diaphragm 1 and which is positioned opposite to and concentric with annular diaphragm 1.

A part of the surface 7*d* of the central plug of the transformer also is in the form of an annular ring and abuts against the inner portion of support ring 2*d* forming an airtight seal with ring 2*d*. A second surface 7*e* of the transformer, which also is in the form of an annular ring, abuts against support ring 2*b* forming an outer, airtight seal with support ring 2*b*. The opposite surface 7*f* of the transformer is a planar flat end of the truncated cone. Magnet 11 supplies the magnetic field through housing 12 to pole pieces 5 and 6.

Figure 2:
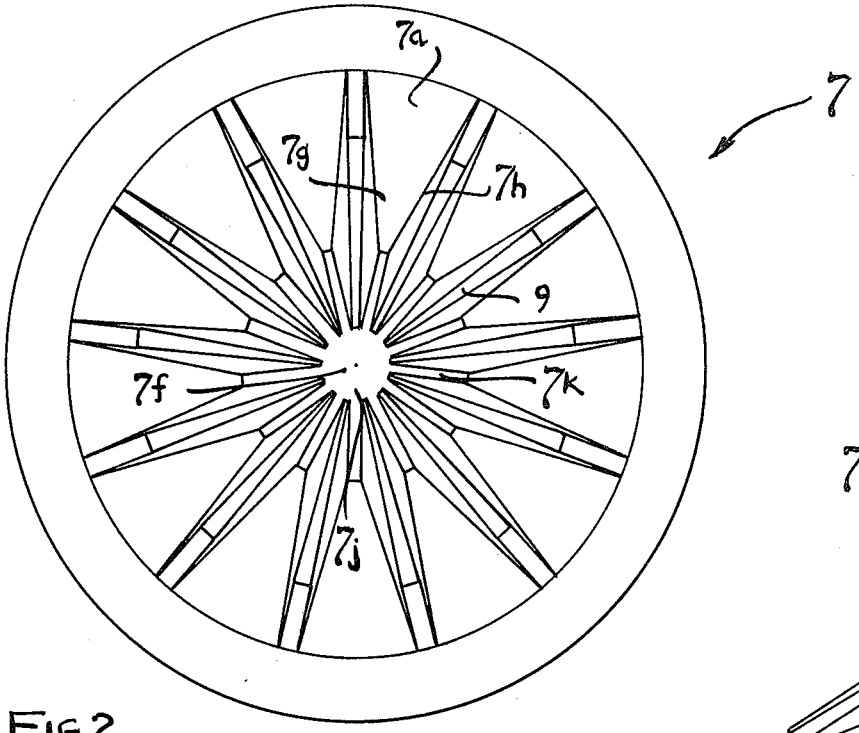
FIG. 2 shows the plug viewed from the horn.

Referring now to FIG. 2. A plurality of radial channels 9, which extend from surface 7*c* to 7*f* (in FIG. 1), are formed between plug sections or slices 7*g*, the side wall portions 7*h* being tapered such that the channels expand in cross section from surface 7*c* to surface 7*f*. In the preferred embodiment, the central or "core" portion 7*j* of the plug is conically shaped, although other, more or less conical shapes may be used, the central portions 7*k* of the "slices" running along the conical sides of the core.

Figure 3:
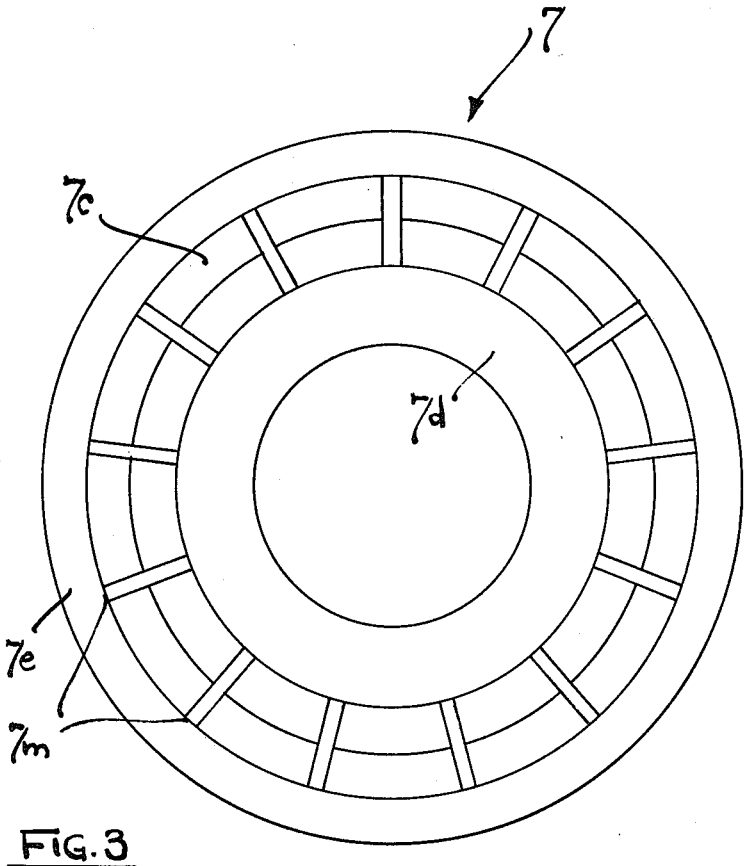
FIG. 3 is a view of the plug from the diaphragm.

The surface 8*a* of frame 8 (in FIG. 1) is in the shape of a truncated cone and for best performance surface 7*a* (in FIGS. 1 and 2) of the slices abuts against surface 8*a* forming a substantially airtight seal. The channels 9 extend through surface 7*c* as a series of axially symmetric rectangular shaped slots or holes 7*m*. The holes, however, can have a shape other than rectangular. The holes 7*m*, which are depicted in FIG. 3, however, do not extend radially through surface 7*e* as annular surface 7*e* is continuous and abuts support ring 2*b* forming an airtight seal. The channels 9 form a set of passageways connecting rectangular openings in surface 7*c* of the plug adjacent to the speaker diaphragm, to radial openings in the plane of surface 7*f* at the throat of the horn. The sound generated by annular diaphragm 1 enters the openings in 7*c*, passes through channels 9, and exits through the plane of surface 7*f* into the throat of horn 10, which throat is located adjacent to surface 7*f*.

Figure 6:
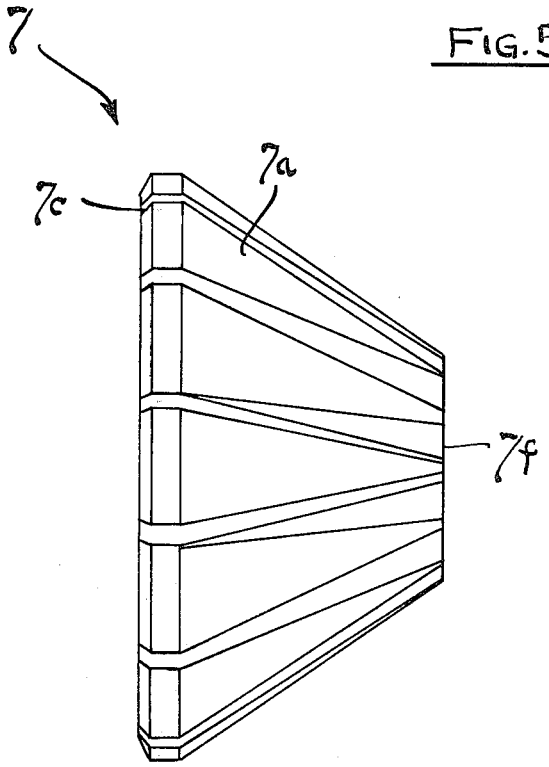
FIG. 6 is a side view of the plug.

It is to be understood that the annular ring of surface 7*e* is not essential to the operation of the plug since an airtight seal over this surface could be obtained by an equivalent surface 7*e* on frame 8 abutting against support rings 2*b* and by extending surface 7*a* of the plug to intersect with surface 7*e*, being everywhere abutting against surface 8*a* of frame 8 which also would be extended to intersect with surface 7*e*. A plug without the surface 7*e* is shown in FIG. 6.

Figure 4:
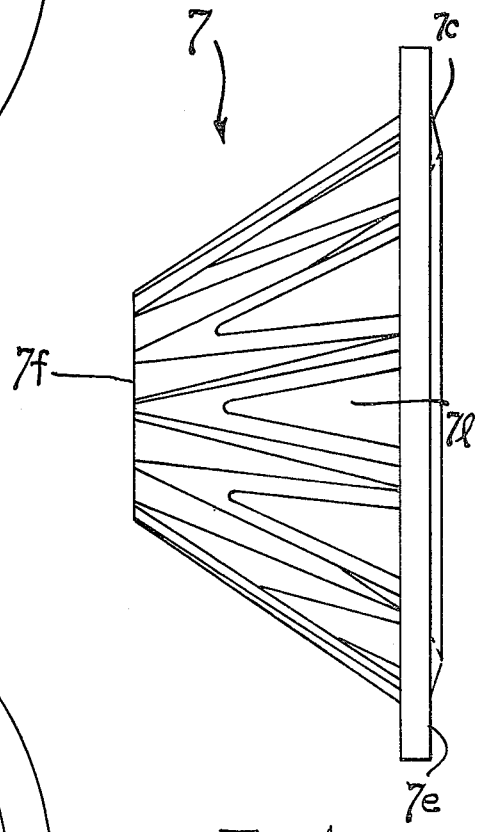
FIG. 4 is a side view of a plug with hollows adapted to injection molding.
Figure 5:
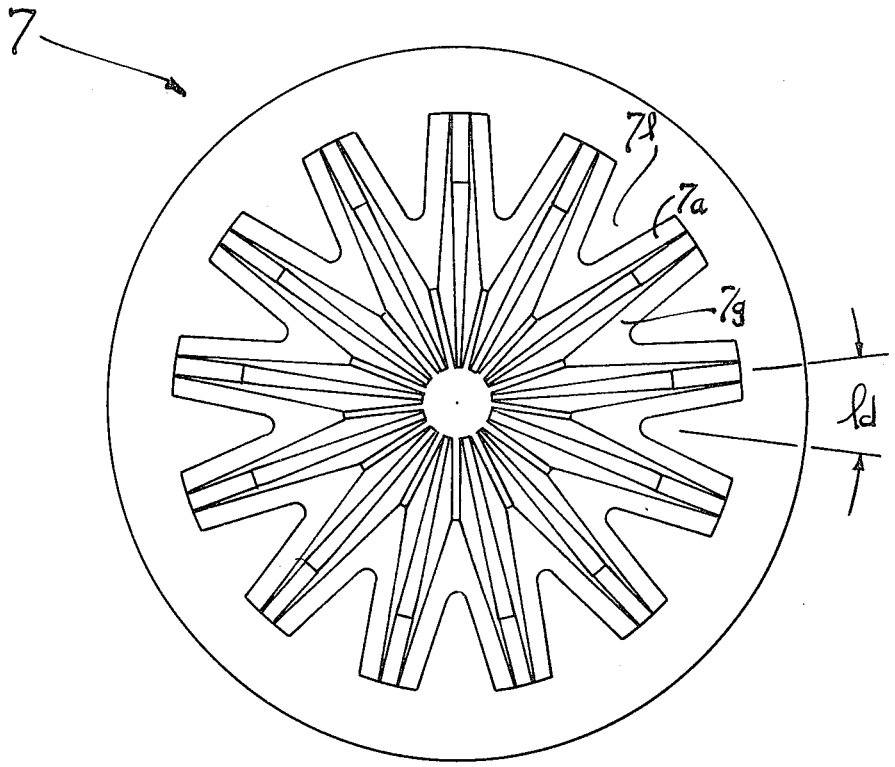
FIG. 5 shows an injection molded plug as viewed from the horn.

Referring now to FIGS. 4 and 5, which depict side and front views respectively, of a slightly different version of the transformer. Referring now to FIG. 5. The sections or slices 7*g* of the plug have an interior portion 7*l* which is hollow. The hollow portion has no effect on the acoustical properties of the plug, however, since surface 7*a* abuts against surface 8*a* of the frame, thus sealing off the hollow interior portion 7*l*. The hollow portions 7*l* facilitate construction of the plug by injection molding techniques.

Referring again to FIG. 5, certain dimensional relationships for the optimum design of the plug are schematically illustrated. The dimension $1_d$ is the distance between the center of each plug section 7*g* and the center of each adjacent channel 9 as measured at the outer periphery of each such section in the plane of surface 7*f*. The dimension $1_d$ preferably is made as small as feasible and should, in any event, be less than a quarter wavelength at the highest frequency of interest for best high frequency performance.

While the invention has been described and illustrated in detail, it is to be clearly understood that this is intended by way of illustration and example only and is not to be taken by way of limitation, the spirit and scope of the invention being limited only by the terms of the following claims.

I claim:

1. An acoustical transformer for coupling sound waves in air, from an annular speaker diaphragm supported by inner and outer supporting rings, to the throat of a horn comprising a member having (a) a substantially truncated, conical surface, (b) a first annular surface substantially conforming to the shape of said diaphragm located at one end of the conical surface, (c) an exit surface opposite the first annular surface, said exit surface forming a truncation to the conical surface, (d) a central core extending substantially between the first annular surface and the exit surface, said central core having sealing means lying inwardly of the first annular surface for forming an airtight seal with the inner supporting ring, (e) a plurality of channels formed in said member, said channels being spaced from each other around the conical surface of said member and extending through said member between the first annular surface and the exit surface thereto, running from the central core radially outwardly to the outer edges of the conical surface of the member, (f) sections of the member being formed between said channels, the opposite wall surfaces of adjacent member sections having a taper, said channels forming tapered sound channels expanding in cross-sectional area from the first annular surface to the exit surface, the exit end of said channels being along the exit surface, the sound waves generated by said diaphragm having an annular wave front, said sound waves entering the channels at the entry end thereof and being transformed to waves having a planar wave front at the exit surface thereof, thereby being adapted for coupling to the throat of said horn.

2. The acoustical transformer of claim 1 wherein said central core portion has a truncated conical shape tapering inwardly between the plane of the first annular surface and the exit surface.

3. The acoustical transformer of claim 1 or 2 wherein the member additionally has a second annular surface located coaxially with, and extending outwardly from, the first annular surface, the channels not extending through the second annular surface.

4. In a compression-type loudspeaker, (a) an annular speaker diaphragm having inner and outer supporting rings, (b) a horn having a substantially planar throat, (c) a cylindrical member having an aperture formed through its center and having a conically dished portion surrounding said aperture, and (d) an acoustical transformer for coupling the sound output of said diaphragm to the throat of the horn, said transformer comprising a transformer member having (1) a substantially truncated conical surface, (2) a first annular surface substantially conforming to the shape of said diaphragm and located at one end of the conical surface and positioned directly opposite the diaphragm, (3) an exit surface opposite the first annular surface, said exit surface forming a truncation to the conical surface, and said exit surface being positioned directly opposite the horn throat and substantially in a plane parallel to that of the throat, the conical surface fitting snugly in the conically dished portion of the cylindrical member, (4) a central core portion extending substantially between the first annular surface and the exit surface, said central core portion having sealing means lying inwardly of the first annular surface for forming an airtight seal with the inner supporting ring, (5) a plurality of channels formed in said transformer member being spaced from each other around the conical surface of said member and extending through the member between the first annular surface and the exit surface thereof, said channels running from said core portion radially outwardly to the outer edges of said transformer member, sections of said transformer member being formed between said channels, the opposing wall surfaces of adjacent sections forming tapered sound channels running between said diaphragm and said horn throat and expanding in cross-sectional area from the first annular surface to the exit surface, the sound waves generated by the diaphragm being transformed by the transformer to planar wave fronts for coupling to the horn throat.

5. The device described in claim 4 wherein the central core of the transformer member comprising the transformer has a conical shape tapering inwardly from the plane of the first annular surface to the exit surface of the transformer.

6. The device described in claim 4 or 5 wherein the transformer member comprising the transformer additionally has a second annular surface located coaxially with, and extending outwardly from, the first annular surface, the channels not extending through the second annular surface.

* * * * *